United States Patent [19]

Bittar et al.

[11] 4,352,412

[45] Oct. 5, 1982

[54] ELEVATOR EXPRESS PRIORITY SERVICE

[75] Inventors: Joseph Bittar, Simsbury; Frederick H. Nowak, Southington, both of Conn.

[73] Assignee: Otis Elevator Company, Farmington, Conn.

[21] Appl. No.: 234,080

[22] Filed: Feb. 13, 1981

[51] Int. Cl.[3] ..... B66B 1/18

[52] U.S. Cl. ..... 187/29 R

[58] Field of Search ..... 187/29

[56] References Cited

U.S. PATENT DOCUMENTS 4,147,235 4/1979 Henry et al. ..... 187/29

FOREIGN PATENT DOCUMENTS 52-18652 2/1977 Japan ..... 187/29

*Primary Examiner*—J. V. Truhe
*Assistant Examiner*—W. E. Duncanson, Jr.
*Attorney, Agent, or Firm*—M. P. Williams

[57] ABSTRACT

Requests for elevator express priority service are assigned to a car committable to the floor of the request if possible, or otherwise to a car which can reach the floor of the request sooner than other available cars. Whenever there are requests for express priority service and no cars available to respond thereto, polling of floor landings in subsequent cycles to determine if there are requests which can be assigned is commenced at a floor landing next in sequence to the one for which an outstanding request was unassignable for lack of available cars, and the unassignable request is reset so as to provide an indication thereof to the requestor. Express priority service requests are reassigned whenever the assignment is outstanding for an impermissible time.

8 Claims, 7 Drawing Figures

ELEVATOR EXPRESS PRIORITY SERVICE

DESCRIPTION

1. Technical Field

This invention relates to elevators, and more particularly to providing improved express priority service in multiple elevator systems.

2. Background Art

It has long been known in the art to provide express priority service for elevators, both in single elevator systems and in multiple elevator systems. Typically, such service is initiated by a keyed switch or a switch which is disposed remotely from the elevator door, thereby to be actuable only by authorized personnel. In a single elevator system, once express priority service is requested, the elevator is caused to stop and the next landing, reverse direction, and advance to the floor requesting the service, stopping with its door open. The authorized personnel then announce the take-over of the elevator and the passengers leave the car. The car is operated then in an express mode by a keyed switch or other actuator which inhibits any floor calls from stopping the car short of the car call imposed thereon by the operator. In group systems, the elevator which is to answer the call has typically been determined simply by counting the floors between the landing requesting the express priority service and all other elevators. The elevator which is spatially closest to the requesting floor is then stopped (if moving, placed in the right direction of advancement, if necessary) and caused to go to the requesting floor.

Problems encountered in prior systems is that the closest elevator is frequently not the elevator which can answer the call most quickly. Further, there may be the opportunity for express priority service requests to be made on several floors, and these floors must be polled to determine which ones are requesting express priority service and to answer that service. In a building with many floors but only a few elevators allowed to respond to express priority service, there is no provision for informing a requester of express priority service that no cars are available to satisfy that service. Furthermore, if the occurrence of more requests than can be satisfied is common, the same floors will be given preference due to the sequence of polling of floors to determine which floors should be provided the express priority service. Additionally, it is possible for an elevator to not answer an express priority service command once it is assigned thereto, for various reasons (such as a janitor blocking the elevator doors with a trash can so as to hold the elevator at a floor). Further, although an elevator may proceed to an express priority floor, the requester may become distracted and not actually place the elevator into emergency service, thereby rendering one less elevator available to serve other express priority requests.

DISCLOSURE OF INVENTION

Objects of the invention include provision of elevator express priority service which informs the requester when no car is available to satisfy it, which gives all possible requesting floors equal chance to have an elevator assigned thereto for express priority service, which can assign a car at a requesting floor directly to the express priority service call, which avoids diminishment of service by outstanding commands to satisfy express priority service, or undue delay in utilizing the elevator assigned to express priority service.

According to the present invention, the floors at which cars have committable floor positions are first checked to see if there are any express priority service requests at such floors, so that such cars can be instantly assigned to answer such calls. In further accord with the invention, in the event that it is determined that no cars are available to satisfy an express priority service request, the express priority service request is canceled, thereby indicating to the requester that a car cannot be assigned thereto, and the sequence is advanced so that the next floor in the sequence can have an opportunity to have a car assigned in a subsequent cycle of operation. In further accord with the invention, the sequence of polling the floors to see if any of them have express priority service requests is rotated so that the same floors don't continuously get first opportunity to have cars assigned thereto. In still further accord with the present invention, the time required for an assigned car to answer an express priority service call is monitored, and the assignment is canceled if not effective within a given time. In still further accord with the present invention, the time required for a car which has answered an express priority service call to be put in service in response to such call is monitored, and if the elevator is not utilized, the call is canceled and the elevator is released.

In accordance with another aspect of the present invention, except in the case where a call is made at the committable floor of one of the cars, the car to answer the call is selected on the basis of the number of floors between the committable floor of the car and the floor of the express priority service request, whether or not the doors are fully closed in the car, and whether the car is running away from the floor.

The present invention provides faster service, more equal service to the several floors of a building, and an indication to the requester in the event that no car is available to satisfy the express priority service request.

The invention may be implemented in a variety of forms utilizing apparatus and techniques which are well within the skill of the art in the light of the teachings with respect thereto which follow hereinafter.

The foregoing and other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
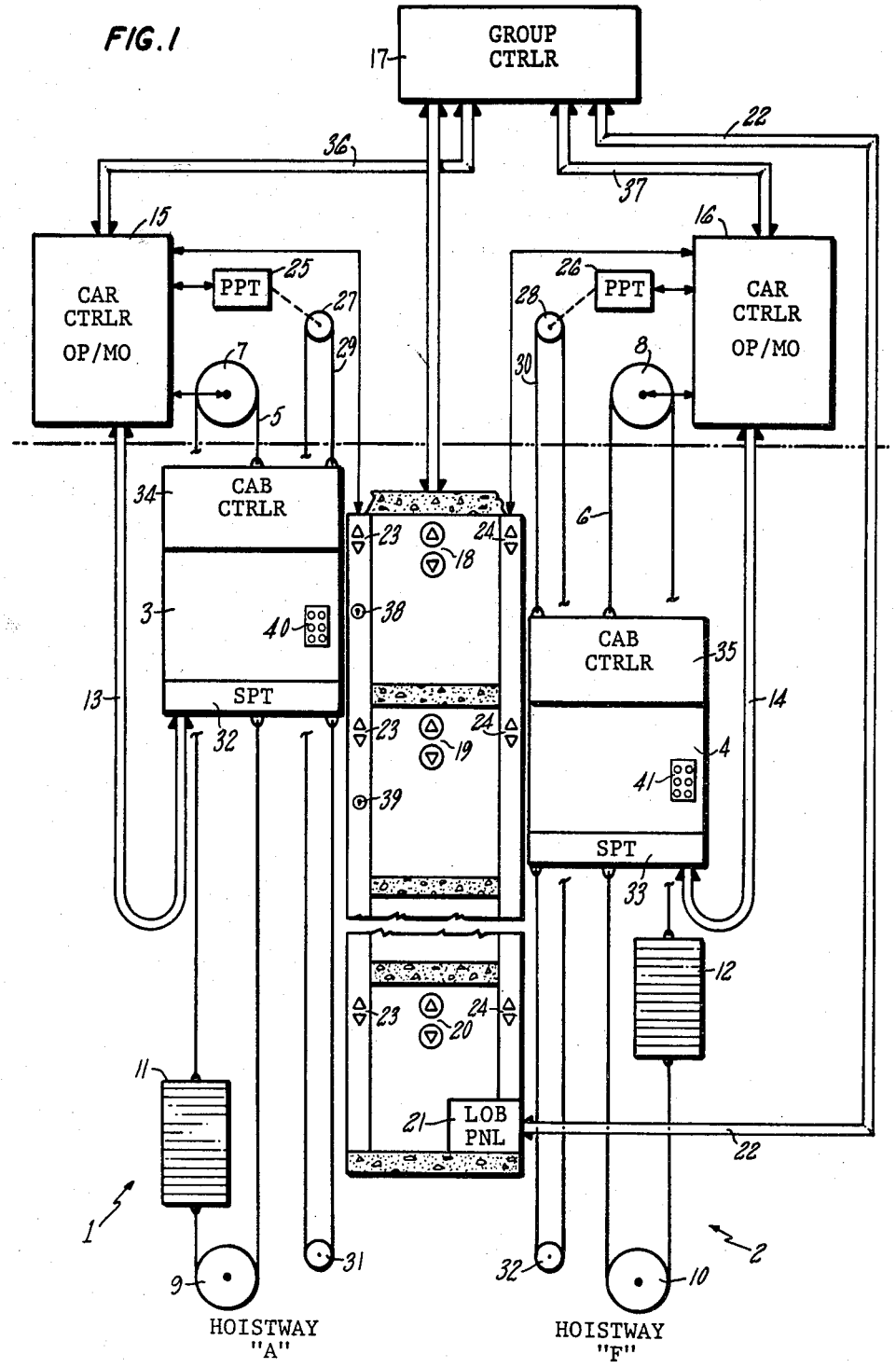
FIG. 1 is a simplified schematic diagram of a multi-elevator system operating under group control in which the present invention may be implemented.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven in either direction or held in a fixed position by a drive sheave/motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975, now abandoned), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself may be directed, or communicated with, by means of a cab controller 34, 35 which may provide serial, time-multiplexed communications with the car controller as well as direct, hardwire communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Mass., U.S.A. And, Simpson, W. E., Luecke, G., Cannon, D. L., and Clemens, D. H., "9900 Family Systems Design and Data Book", 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Design News), Boston, Mass., U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments' 9900 family, and suitable interface modules for working therewith, an elevator control system of the type illustrated in FIG. 1, with separate controllers for the cabs, the cars, and the group, has been implemented utilizing real time interrupts, in which power-on causes a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the communication register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 34, 35, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired. The controllers 15, 16, 17, may each be based on a microcomputer which may take any one of a number of well-known forms. For instance, they may be built up of selected integrated circuit chips offered by a variety of manufacturers in related series of integrated circuit chips, such as the Texas Instruments 9900 Family. Such a microcomputer may typically include a microprocessor (a central control and arithmetic and logic unit), such as a TMS 9900 with a TIM 9904 clock, random access memory, a read only memory, an interrupt priority and/or decode circuit, and control circuits, such as address/operation decodes and the like. The microcomputer is generally formed by assemblage of chips on a board, with suitable plated or other wiring so as to provide adequate address, data, and control busses, which interconnect the chips with a plurality of input/output (I/O) modules of a suitable variety. The nature of the I/O modules depends on the functions which they are to control. It also depends, in each case, on the types of interfacing circuitry which may be utilized outboard therefrom, in controlling or monitoring the elevator apparatus to which the I/O is connected. For instance, the I/Os which are connected to car call or hall call buttons and lamps and to switches and indicators may simply comprise buffered input and buffered output, multiplexer and demultiplexer, and voltage and/or power conversion and/or isolation so as to be able to sense cars hall or lobby panel button or switch closure and to drive lamps with a suitable power, whether the power is supplied by the I/O or externally.

An I/O module may provide serial communication over current loop lines 13, 14, 36, 37 between the car controllers 15, 16 and the cab controllers 34, 35 and the group controller 17. These communications include commands from the group controller to the cars such as higher and lower demand, stop commands, cancelling hall calls, preventing lobby dispatch, and other commands relating to features, such as express priority service when requested by a switch 38, 39. These communications also include information concerning car calls, normally requested by buttons in panels 40, 41 exchanged between cab and car controllers as well as the group controller. The group controller initiates communication with each of the car controllers in succession, and each communication operation includes receiving response from the car controllers, such as in the well known "handshake" fashion, including car status and operation information such as whether the car is in the group, is advancing up or down, its load status, its position, whether it is under a go command or is running, whether its door is fully opened or closed, and other conditions. And each car controller 15, 16 engages in similar communication with its own cab controller 34, 35. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends is unnecessary and not included herein.

Overall program structure of each controller, based upon a data processing system, in which the present invention may be practiced, is reached through a program entry point as a consequence of power up causing the highest priority interrupt, in a usual fashion. Then a start routine is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine in which all forcing (FORC) and all inhibit or cancel (INH) functions are cleared from memory; field adjustable variables are read and formatted as necessary; the status of each car is read and formatted as necessary; and all the hall calls and car calls are read, and corresponding button lights for sensed calls are lit. Then, all inputs obtained by communication between the cars, the cabs and the group are distributed to the various maps and other stored parameter locations relating thereto.

After initialization a variety of elevatoring functions are performed by various routines on various time bases. Such routines include assigning cars to answer hall calls, parking cars in zones, handling up peak and down peak traffic, and various other functions, including the emergency priority service described hereinafter with respect to the present invention. The car controllers 15, 16 may be implemented in a fashion similar to that described hereinbefore with respect to the group controller 17, having I/O devices suitable for communication with the cab controllers 33, 34 over lines 13, 14 and suitable for interacting with circuitry for controlling the sheave/motor/brake assemblies 7, 8 as well as any related transducers, such as the primary position transducers 25, 26. The car controller has a principal task of controlling the motion of the cab, and at times controlling the cab door. These functions necessarily include other, known subfunctions such as recognizing car calls, and responding to car calls or floor calls assigned by the group (or otherwise) in conjunction with the position of the cab to cause the cab to open and close its doors at appropriate times. Since these functions, and the communications between the various controllers to effect them, are, except as provided hereinafter with respect to the present invention, generally known and within the skill of the art, no particular aspect of them being involved herein except as provided hereinafter, further discussion thereof is not otherwise provided herein.

The programming within the group controller 17 is arranged, to reach an express priority service routine on a repetitive basis, such as once in each 200 millisecond overall cycle.

Figure 2:
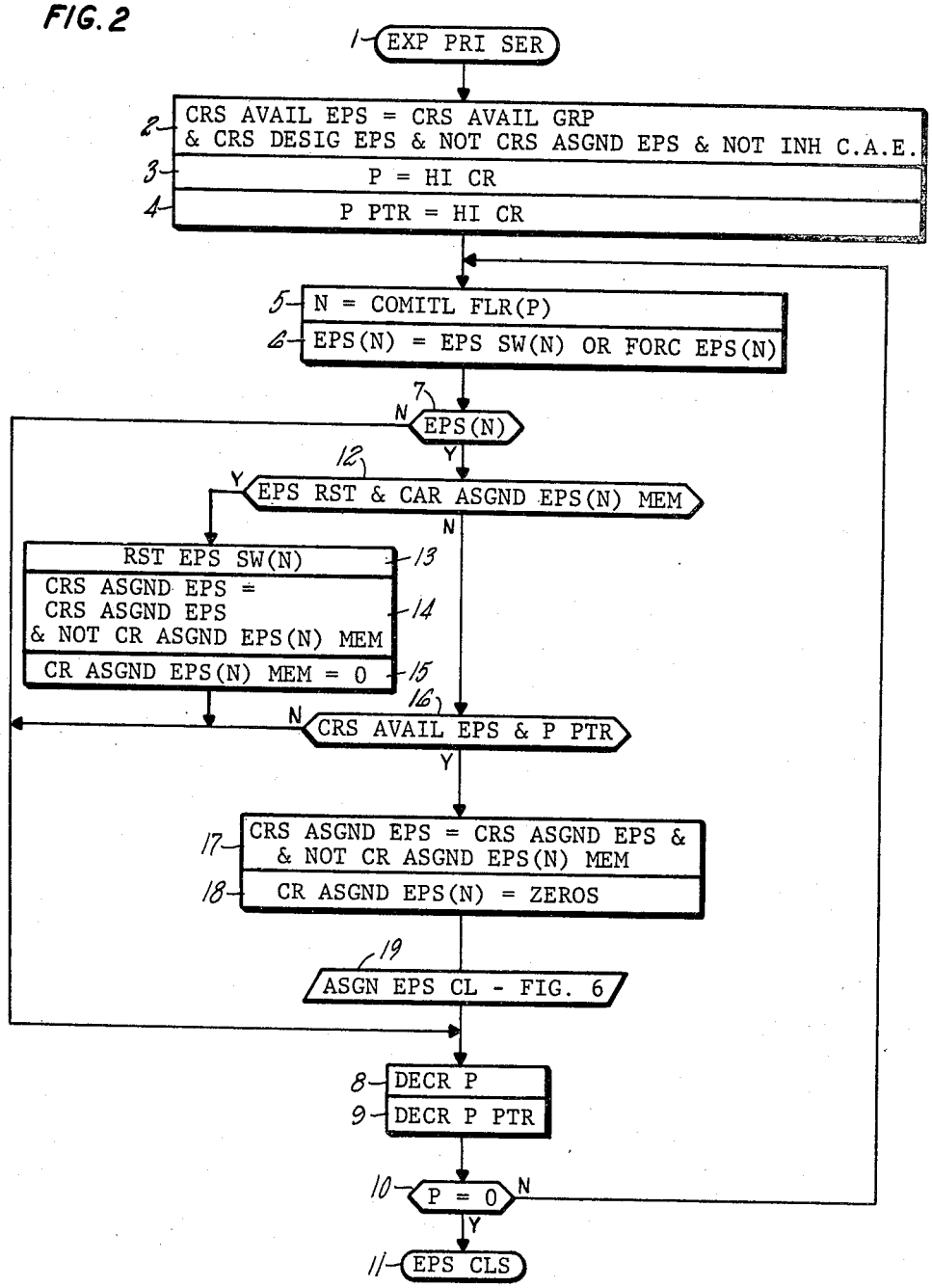
FIG. 2 is a simplified logic flow diagram of a program for resetting express priority service requests and for instantly assigning express priority service requests to cars having as their committable floor, the floor where the request is being made.

This routine includes portions illustrated in FIG. 2 for determining when express priority service requests have been answered and should be reset, and for determining when cars are immediately available at a floor where express priority service is requested, although the express priority service call has not been assigned to such car, and transferring the assignment thereto. The express priority service routine includes portions illustrated in FIG. 3 in which all of the served floors are surveyed to determine if there is any outstanding express priority calls, and utilizing the subroutines of FIGS. 5 and 6 to select a suitable car to answer such calls and to assign such calls to cars when possible. The express priority service routine also includes a portion illustrated in FIG. 4 to refresh a directive to the car controllers 15, 16 that express priority service has been assigned to it for a specific floor, until the service has been provided. The car controllers 15, 16 react in a fashion illustrated with respect to a car express priority service program performed within the car controllers, as described with respect to FIG. 7 hereinafter.

In FIG. 2, the express priority service routine reached through an entry point 1 includes a first step 2 in which a map of the cars available for express priority service (a word of bits, a bit being established in one state, such as ONE, for each car that can be used in express priority service at the present time) is updated by ANDing together the map of cars which are available to the group, a map of cars designated for EPS service, a map of cars not already assigned to EPS service, and the complement of a map inhibiting cars available for express priority service (which may be utilized in unusual cases, such as fireman service, or the like). Then in steps 3 and 4 a P counter (P being simply a working number that allows selecting one car at a time, for consideration of express priority service functions) is set to the car number of the highest numbered car in the group. And in a step 4, a P pointer (a map in which only one car at a time is designated with a suitable bit) is set so that the bit of the highest numbered car is designated. Then, a step 5 sets a floor number counter, N, to the committable floor of the selected car, and a step 6 sets an EPS flag designating that emergency priority service has been requested for the Nth floor, if either the emergency priority service switch for the Nth floor or a forcing function for emergency priority service to the Nth floor either has been set. Then a test 7 determines whether or not emergency priority service is requested for the Nth floor. If not, the program advances to steps 8 and 9 where the P counter and P pointer are both decremented and a test 10 determines if all of the cars have been tested (which is true when P equals zero) and if so, the program advances through a transfer point 11. Otherwise, the next car in sequence is treated.

In FIG. 2, if there is an emergency priority service request for the Nth floor, test 7 is affirmative and a test 12 determines if the map of cars directing that their emergency priority status be reset and the map of cars assigned to serve the particular emergency priority service request for floor N have an identical pair of bits. If they do, an affirmative result of test 12 indicates that there is a request at floor 7 but this request is being answered by a car which has now answered the call and therefore has indicated that a reset should occur. Thus an affirmative result of test 12 will reach a step 13 which will reset the indicator of the emergency priority switch for floor N, a step 14 in which the map of cars assigned to emergency priority service is updated by ANDing it with the complement of a memory map (that is a map which is a buffer map) of the car assigned to emergency service for floor N. Since, in this case the call has been answered by this car, the memory map will have a bit therein, the complement will not and therefore this causes erasure of car P from the map of cars assigned to emergency priority service. Immediately thereafter, a step 15 resets the memory map since it is no longer needed, and since that emergency priority service call has been cancelled.

Recalling that step 5 selects floor N as the committable floor of car P, if test 12 is negative, this means that there is a car at a floor where emergency priority service has been requested but this car has not had the call assigned to it. As is described hereinafter, the car which was assigned to it should have gotten there before any other car. Therefore, this indicates that the assigned car has been unusually delayed and that therefore reassignment to a car which is approaching or at the floor might be made so as to answer the call more quickly. Thus a negative result of test 12 leads to a test 16 to determine if the present car is available for EPS service. As established in step 2, if car P is a car which can handle emergency priority service (as determined by the definition of the building), is available to the group in general and not otherwise assigned, and not already designated to answer a different emergency priority service call, then car P will be available to serve, otherwise it will not. If it is not, the test 16 will be negative and the next car will be taken up in sequence as a result of steps 8, 9 and test 10. But if this car is available, test 16 will be affirmative and will reach a step 17 in which the previous car's assignment is canceled by updating the map of cars assigned to emergency priority service with the complement of the memory map which identifies the car previously assigned to emergency service for floor N. And, the fact that a car has been assigned to answer the call for emergency priority service at floor N is reset by resetting the map of the car assigned to answer the call to floor N in a step 18. Then the call will be assigned to the present car by a routine 19 which is described more fully hereinafter with respect to FIG. 5. And then, the routine of FIG. 2 will take the next car in sequence until all of the cars have been compared against emergency priority service calls at their committable floors. Thus the subroutine of FIG. 2 looks at only the floors where the cars are approaching or stopped, and not all of the floors of the building in general. And with respect to each floor that a car is approaching or at, will handle any reset of a call which the car is answering, and will unassign any call which that car is reaching prior to some other previously assigned car, so that a new assignment can be made to the present car.

Figure 3:
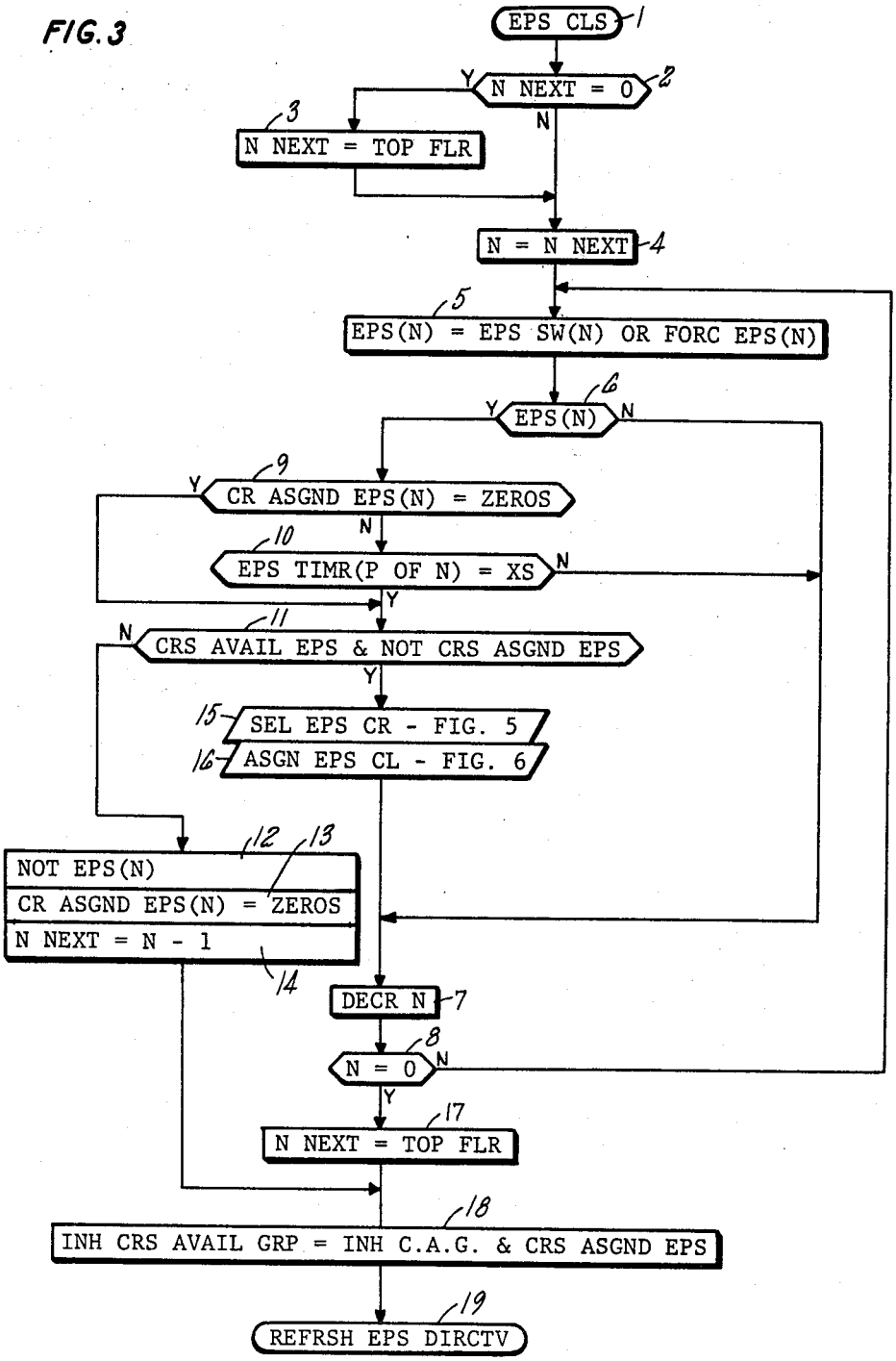
FIG. 3 is a simplified logic flow diagram of a program for determining if there is an outstanding express priority service request in a car which can answer the request, and for polling the floors for requests in a varying sequence.

Once the situation of cars being at specific floors where emergency priority service has been requested is accommodated by that portion of the emergency priority service routine of FIG. 2, the program advances to the emergency priority service calls portion thereof illustrated in FIG. 3, through an entry point 1. The portion of the EPS routine of FIG. 3 checks all of the floors in the building to determine if there are any unassigned requests for emergency priority service. It does this by scanning from floor to floor; but, in order to treat all of the floors equally, rather than answering the floors in some fixed sequence which would preferentially treat the lower numbered or the higher numbered floors preferentially, one aspect of the invention is provision of a rotation in the beginning point for scanning of floors to determine if there are any unassigned emergency priority service request calls, and assigning cars to such calls when cars are available for assignment to them. This is achieved as illustrated in FIG. 3, by a floor number register referred to as N NEXT, which keeps track of the place where polling should commence in each successive pass through the EPS program. In FIG. 3, test 2 determines whether the lowest numbered floor has been reached or not. If it has, test 2 will be affirmative and a step 3 will set N NEXT to the highest numbered floor. If not, test 2 is negative and a step 4 sets a working floor number counter, N, to N NEXT. Then, for floor N, a bit indicating that emergency priority service has been requested will be set if either the emergency priority switch for floor N or the forcing of emergency priority service for floor N are indicated, in a step 5. Then this status is tested in a test 6, and if there has been no emergency priority service request by switch or a forcing thereof, test 6 will be negative reaching a step 7 in which the floor number N is decremented and a test 8 which determines whether all the floors have been tested or not. If not, step 5 is returned to for the next floor in sequence.

In FIG. 3, if test 6 is affirmative, this means that there is an emergency priority service request outstanding on floor N. An affirmative result of test 6 will cause a test 9 to determine if this emergency request had previously been assigned or not, which, by test a pointer which indicates if any car has been assigned. If so, then an EPS timer for the car which was assigned to the call is tested in a test 10 to determine whether an impermissible amount of time has elapsed since the call had been assigned to a car. If not, the next floor in sequency is reached through step 7 and test 8. But if the call had not been previously assigned as indicated by test 9 or the previous assignment has not been answered within a permissible time as indicated by test 10, then a determination is made, as to whether or not there are any cars available to respond to this emergency call, in a test 11 which ANDs a map of cars available for emergency priority service with the complement of a map of cars previously assigned to emergency priority service. If test 11 is negative, there are no cars which can be assigned to any emergency priority service requests, and therefore there is no point of testing any other floors since no cars can be assigned to them anyway. This terminates the polling of floors to see if there are emergency priority service requests which can be assigned to cars. The negative result of test 11 causes the call for floor N to be reset in a step 12 thereby providing an indication at the floor that the request is not being responded to. This aspect of the invention warns the requestor that a car is not on its way. Then, step 13 resets the pointer indicative of which car is assigned to this call (in case of timeout, test 10) and a step 14 sets N NEXT to be equal to the next lower floor than the one which just failed to have its request assigned, to alter where polling begins the next time around. On the other hand, if test 11 is affirmative, there is at least one car which can be assigned to the call for this floor, so a subroutine 15 is called to select a car for assignment to an emergency priority service call, as described with respect to FIG. 5 hereinafter, and the assign EPS call subroutine 16 is called, as described with respect to FIG. 6 hereinafter, to assign this call to a car selected in the routine of FIG. 5. After this call is assigned to a selected car, it is not yet known whether or not any other cars are available or there are any calls which require emergency priority service. Step 7 will decrement the N counter and test 8 will determine if all the floors have been tested or not. If not, the subroutine of FIG. 3 will return to step 5 to test an additional floor. But if the lowest floor (zero) has been reached as indicated by an affirmative result of test 8, then a step 17 will cause the N NEXT counter to be set to the top floor so that polling will begin thereat the next time around. Thus the polling of the floors can be completed because there are no more cars available (test 11) or because the lowest numbered floor has been reached (test 8). In either case, a step 18 updates the map of inhibiting cars available to the group by ANDing that map with the map of cars assigned to answer emergency priority service calls, so that any assignments made in the subroutine 16 will result in the assigned car being no longer available to satisfy demand in answering hall calls or filling in empty zones by the group controller. Thereafter, the emergency priority service routine advances through a transfer point 16 to a portion thereof in which the directives for emergency priority service to the various cars assigned to answer emergency priority service calls are refreshed on a periodic basis, as illustrated in FIG. 4.

Figure 4:
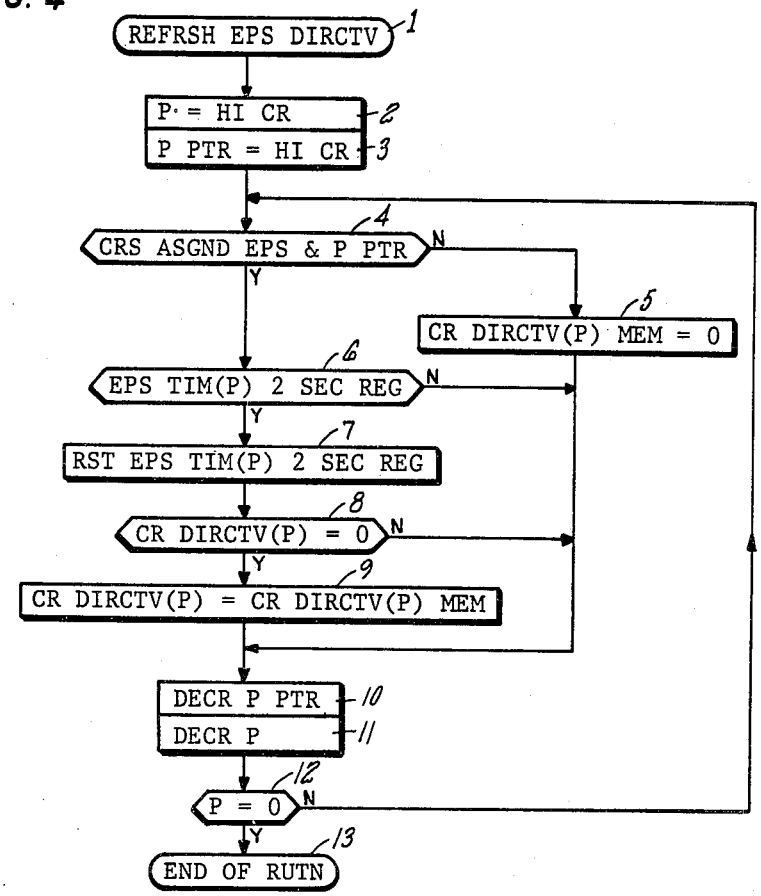
FIG. 4 is a simplified logic flow diagram of a program for refreshing express priority service directives from a group controller to car controllers assigned to answer express priority service calls.

In FIG. 4, the refresh EPS directives portion of the express priority service routine is reached through an entry point 1 and a pair of steps 2, 3 set the P number to the highest car and the P pointer to the highest car in the usual way. Then a test 4 determines if the car under consideration is assigned to emergency priority service by ANDing the map of cars assigned to emergency priority service with the P pointer. If test 4 is negative, the memory bit representing that car P should be directed to answer an emergency priority service call is reset to zero in a step 5. On the other hand, if step 4 is affirmative, then the EPS timer for the car indicated by the P pointer is checked in a test 6 to see if two seconds have elapsed since the last time this timer was interrogated. This may be achieved by setting a register indicative that two seconds have elapsed, and resetting it in a step 7 each time that its test is affirmative. If the two seconds have not elapsed, nothing happens, but if the two seconds have elapsed, step 7 will reset the two second buffer register and a test 8 will determine if the car P car directive (for answering emergency priority service) is zero. If it is not zero, it is left undisturbed. But if it is zero, the memory of the car directive is used to reestablish the car directive in a step 9. Thus, whenever a car directive established by the assignment routine of FIG. 6, has been sent once, and is reset by the communications function of the group controller, the memory of that directive is used to periodically restore the directive, in step 9 of FIG. 4, for re-communication to the car controller.

When all of the cars which are to receive directives to answer emergency priority service calls have been updated, the decrementing of the P pointer and P counter in steps 10 and 11 will cause a test 12 to be affirmative, ending the emergency priority service routine of FIGS. 1–3, and other programs of the group controller are reached through the end of routine point 13. The directives are themselves sent to the various cars as a consequence of routine communications, wherein words are formatted to indicate various statuses, including the emergency priority service command as set in the memory map of cars to receive directives for emergency priority service.

Figure 5:
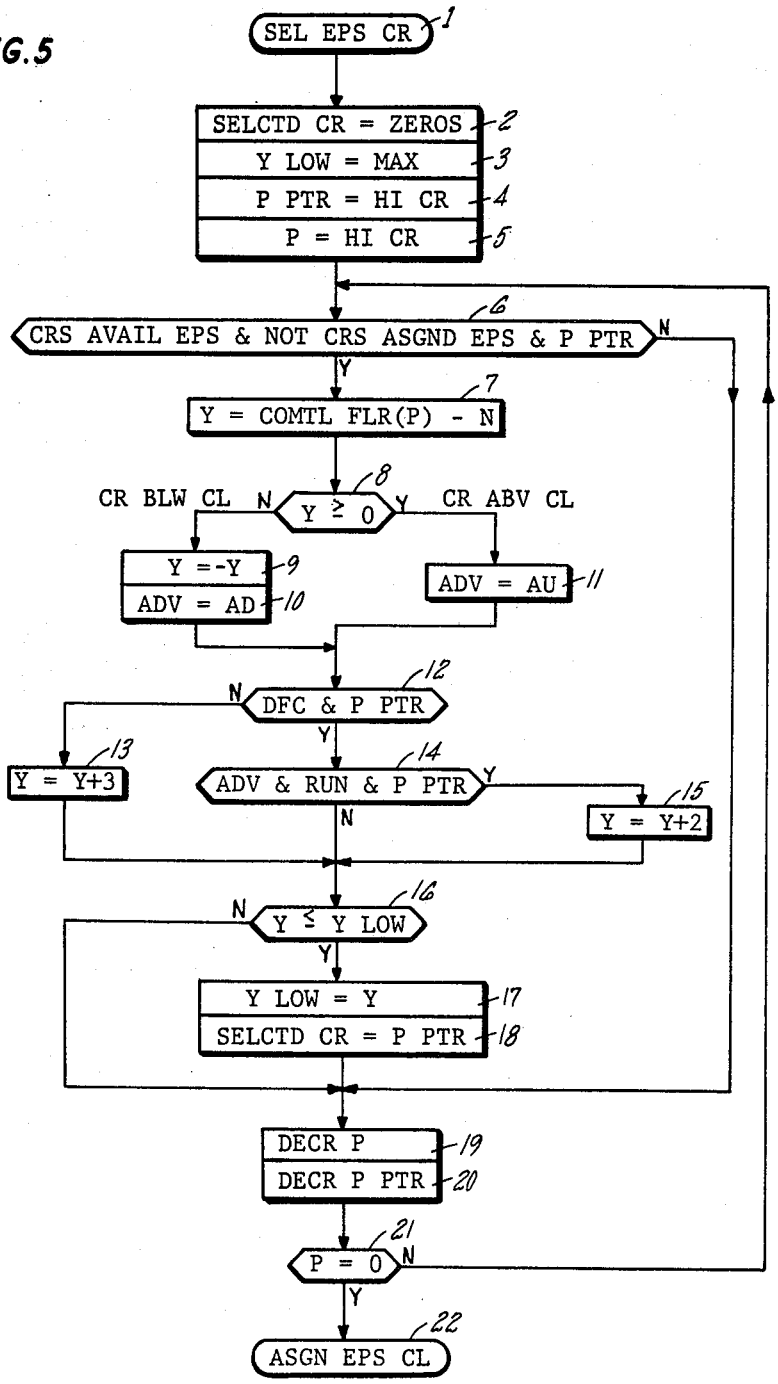
FIG. 5 is a simplified logic flow diagram of a program for selecting a car which can substantially answer an express priority service call most quickly.

The select emergency priority service car subroutine, which is called within that portion of the express priority service routine illustrated in FIG. 3, is entered in FIG. 5 through an entry point 1. Then a step 2 sets a selected car pointer (a word containing a bit for each car, a particular bit, such as ONE, indicating the selected car) to all zeros. A step 3 sets a car selecting parameter, called Y LOW, to a maximum value, and steps 4 and 5 set the P pointer and the P counter to the number of the highest numbered car. Then a test 6 determines if the car designated by the P pointer is available for emergency priority service and not already assigned thereto by ANDing the maps thereof with the P pointer. If the present car is currently available, an affirmative result from test 6 will reach a step 7 in which the value Y is set to the committable floor of the selected car minus the floor number (N) of the emergency priority service call which is to be assigned. This number N is set in either step 4 or step 7 of the EPS routine portion of FIG. 3, depending on how far that portion of the routine had proceeded, as described hereinbefore. The value Y determined in step 7 is indicative of the number of floors and the up/down relationship between the committable floor of the car and the call to be assigned. If Y is a positive value, the selected car is above the EPS call; if Y is a negative value, the selected car is below the EPS call. The situation of Y being zero, indicating that the selected car is at or approaching the floor of the emergency priority service call to be assigned, should not occur because this would either be a case where the call is being answered and the call should therefore be reset as described with respect to FIG. 2, of if the assigned car is delayed and the present car is at the floor, the call would be reassigned. And, when reassigned, the pointer of test 9 in FIG. 3 would prevent further assignment of that call. These conditions are established by a test 8 where an affirmative result indicates that Y is equal to or larger than zero meaning the car is at or above the call and a negative result indicates that the car is below the call. If the car is below the call, the value of Y is negative and so a step 9 changes the sign of Y so it simply represents the number of floors between the committable position of the car and the call to be assigned. Depending on the result of test 8, a selected one of steps 10 and 11 will set an advance map (a local map used only in this subroutine) to be equal to the advance map in the direction which will occur if the car is running away from the call. For instance, if test 8 is affirmative and the car is above the call, the advance map is set in step 11 to be equal to the advance up map; if the advance map does have a bit set for this car, indicating that the car is traveling upwardly, and it is above the call, this means that the car is traveling away from the call. Similarly, if a car is below the call, the advance map is set equal to the advance down map.

In FIG. 5 a test 12 determines if the map of cars having their doors fully closed includes a bit for the car in consideration by ANDing that map with the P pointer. If the result is negative, that means the doors of the selected car are not fully closed so that a step 13 adds a three floor penalty to the value of Y. If step 13 is performed, the value of Y now equals the number of floors between the call and the car and a three floor penalty for having the doors of the car open. If the doors are open, it is not possible for the car to be running, so it is irrelevant whether the car is under an advance up or advance down command because, as is explained hereinafter, if the car is stopped with its doors open and is selected for the call, the car will be commanded to the floor of the call without regard to its prior advance command. For that reason, only an affirmative result of test 12 (indicating that the doors are fully closed) will reach a test 14 in which it is determined whether or not a car is running away from the call. Because of how the advance map is set, the advance map is indicative of an advance direction which is away from the call. Therefore, ANDing of the advance map, the map of cars which are running, and the P pointer will indicate whether the selected car is running away from the call. If it is, an affirmative result of test 14 will add a two floor penalty to the value of Y, in a step 15. This is a penalty that allows an equivalent of floor running time which is about equal to the amount of time it takes to give a stop command to the car (if necessary) and issue a car call to cause the car to run in the opposite direction to answer the emergency priority service call, as explained hereinafter. In addition to the conditions indicated by tests 12 and 14, there are two other possible conditions. One is that the car is running toward the call and the other is that the car may be stopped at a floor with the doors fully closed and about to accelerate in the direction of the call. These are equivalent times since the position of a moving car is some distance from its committable floor, and time is required to reach that committable position; and it takes some time to accelerate a stopped car. Due to this equivalency, no care need be taken to separate the two. And, the absolute time it will take the car to reach the call is not the controlling parameter, but simply the relative time for the various cars.

In FIG. 5, the car having the lowest value of Y is selected as the car which can answer the call most quickly. Recalling that Y is a factor equal to the number of floors between the committable position of the car and the call, together with penalties for having doors fully closed or running away from the call, test 16 compares the value of Y of each car with the next previously selected lowest value of Y. Initially, Y LOW is set at a maximum value. If test 16 is affirmative (which it always will be for the first car tested), then an affirmative result of test 16 causes a step 17 to set Y LOW equal to Y and to set a pointer of the selected car equal to the P pointer in a step 18. Then steps 19 and 20 decrement the P counter and the P pointer so as to represent the next lower car in the sequence of cars, and a test 21 determines whether or not all the cars have been tested. If not, the subroutine reverts to test 6 for the next car in the sequence. When all the cars have been tested, an affirmative result of test 21 will cause the assign EPS call subroutine to be reached through a transfer point 22.

Figure 6:
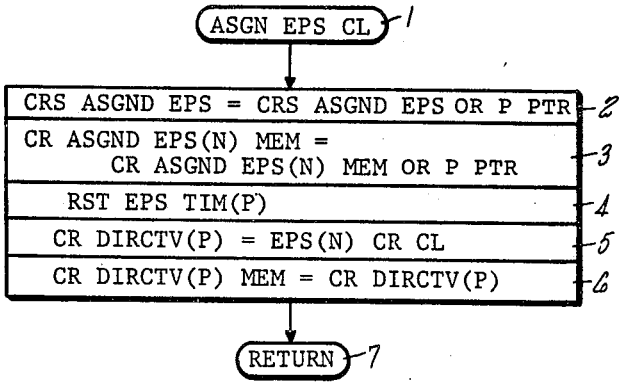
FIG. 6 is a simplified logic flow diagram of a program for assigning express priority service calls to selected cars.

In FIG. 6, the assign EPS call subroutine is reached through an entry point 1 and a step 2 sets the map of cars assigned to EPS calls equal to itself ANDed with the P pointer. This adds the most recently assigned car to that map and removes any recently unassigned car (such as may have occurred during the first part of the express priority service program described with respect to FIG. 2 when a call is reset). Note that when an emergency priority service call has been answered by the appearance of a car, the call is reset and the car will, shortly thereafter, no longer be assigned to emergency priority service by the group, because the car will be put on independent service (outside of group control) by the operator of the car who placed the emergency call in the first place. This is described more fully with respect to FIG. 7 hereinafter.

In FIG. 6, a step 3 causes the memory map of the car assigned to the emergency priority service call floor N (the floor currently under consideration, as set by step 5 in FIG. 2 or as set by either step 4 or step 7 in FIG. 3) to be updated by ANDing itself with the P pointer in the usual fashion. A step 4 resets the emergency priority service timer for the selected car so that test 10 in FIG. 3 can determine whether or not an assigned car has taken an excessive amount of time and failed to reach the call, as well as to begin the repetitive two second time-outs utilized in the refreshing of directives as indicated in test 6 of FIG. 4. Then a step 5 causes an immediate call directive for car P to be set to an emergency priority service car call to floor N. This will cause the next communication, between the group and the car controller of car P, to include a directive to force a car call (and other functions described with respect to FIG. 7) so as to effect answering the emergency priority service assigned to it at floor N. In order to accommodate refresher directives later on (in the case that a power interruption or other condition could cause the car controller to lose track of what the group has told it to do), a memory car directive is set in step 6 to be equal to the car directive which is established in step 5. Thus, once the car directive is sent, and further communication words are formatted for other purposes, the refresh EPS directive routine portion of FIG. 4 will utilize the memory car directive set in step 6 to determine the word to be formatted for periodic sending to the selected car, until the call is answered or reassigned. Then the appropriate part of the program (step 8 of FIG. 2 or step 7 of FIG. 3) is returned to through a return point 7.

Figure 7:
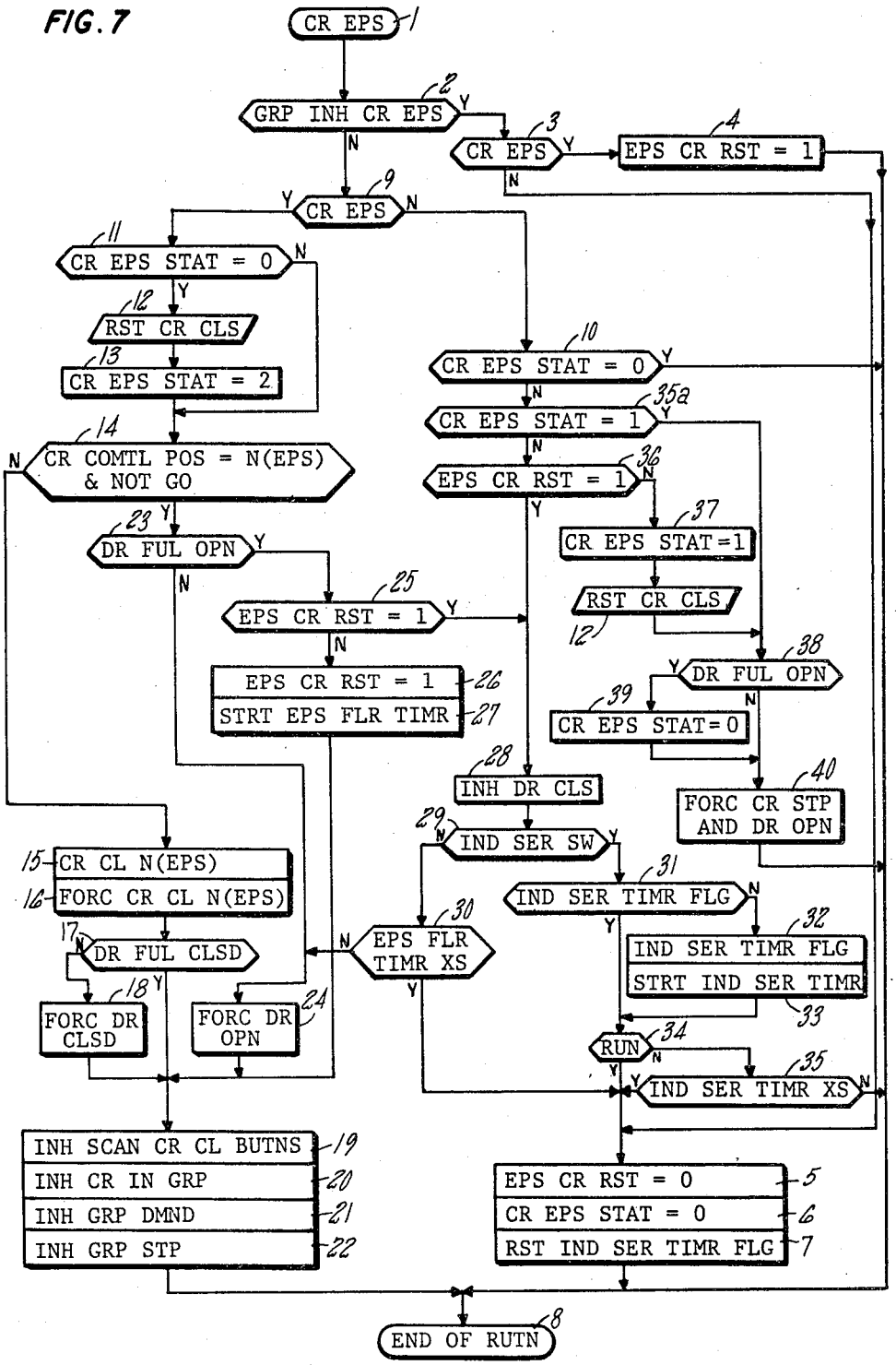
FIG. 7 is a simplified logic flow diagram of a program which may be implemented in the microprocessor of an elevator car controller in responding to express priority service call and transferring to independent service.

The description thus far with respect to FIGS. 2 through 6 is indicative of exemplary routines for causing the microprocessor of the group controller 17 (FIG. 1) to recognize and handle emergency priority service calls. The reaction of the car controller 15, 16 to the car directives which are transmitted by the group to the car as a consequence of communications following the setup established in FIG. 4, is indicated in an exemplary fashion in FIG. 7. FIG. 7 represents an exemplary routine for the microprocessor of a car controller 15, 16 (FIG. 1), to respond to the car directive established initially in step 5 of FIG. 6 and thereafter repeated as a consequence of step 9 in FIG. 4. When the communication of the car directive is received by the car, it is converted to a flag bit indicating that emergency priority service is being commanded of it and a word indicating the floor number where that service is being commanded.

In FIG. 7, the car emergency priority service routine is reached on a periodic basis, such as once every 200 milliseconds (one per basic cycle of the car controller microprocessor) through an entry point 1. A test 2 determines if the group has issued a command inhibiting emergency priority service by this particular car. Such might be the case in the event of fireman service, in which the group might inhibit all independent service by the cars, one at a time, in order to permit fireman service control over the cars. If group test 2 is affirmative than a test 3 determines if this particular car has an outstanding emergency priority service command. If it does, a step 4 will set an emergency priority service car reset flag equal to ONE, which tells the group that this car's emergency priority service command should be reset by the group controller. But if test 3 is negative, indicating that this car does not have any outstanding emergency priority service command, the routine of FIG. 7 advances to three conclusionary steps 5–7 which are normally reached at the time that the car has answered the call; step 5 causes the EPS car reset to be equal to ZERO, step 6 causes the status of the car in responding to an EPS command to be set to the lowest status state (ZERO), and step 7 causes resetting of an independent service times flag, which is described hereinafter. And then the routine is ended through an end of routine point 8.

In FIG. 7, the general case is that test 2 will be negative reaching a test 9 to determine if this car has been given (and still has outstanding) an emergency priority service request. If the car does not have an outstanding request, test 9 will be negative, and if the car's emergency priority service status is the low or quiescent status (ZERO), a test 10 will be affirmative and the program will simply advance through the end of routine point 8. This is a very normal situation where the car is not responding to a call; that fact is tested by the car's program every 200 milliseconds or so (one each major repetitive cycle of the car controller). On the other hand, in the event that this car does have an emergency priority service request to answer, test 9 will be affirmative. This will reach a test 11 which determines whether this car's emergency priority service status is the low, quiescent status or not. If it is, this means that the program is advancing through the car emergency priority service routine the first time since an emergency priority service request has been directed to the car. Therefore, an affirmative result of test 11 will reach a subroutine 12 which will cause all the car calls for this car to be reset, and a step 13 which causes the car EPS status to be set to TWO. The car EPS status is ZERO when the car has indicated that it has completed all emergency priority service and has been reset as a consequence; the status is ONE whenever the car does not have an outstanding emergency priority service request but it has not caused itself to be reset (meaning that the outstanding request is canceled by the group, rather than being answered by the car); and the status is TWO when there is an emergency priority request outstanding and the car is trying to reach that request. In normal cases the status will transfer upon a request from ZERO to TWO, and when the car has reached the requesting floor, the status will revert from TWO directly back to ZERO.

In FIG. 7 once the request is initialized by subroutine 12 and step 13, other aspects of the car control program will be forcing the car to advance in the correct direction from the floor where emergency priority service is requested. When the car has reached the requesting floor as a result of a forced car call to that floor, the car will have a committable position at the floor requesting emergency priority service, and will lose its go command. Therefore, a test 14 determines whether or not the car has essentially reached the requesting floor. Initially, when the request is first received, the car will not usually be at the requesting floor (except where a car is assigned to a call when the car is committed to the floor of the call), and depending upon its motion status when the call is first received, it may or may not have a go command. In the general case, test 14 will initially be negative. This will cause a step 15 to force a car call to floor N (the floor requesting priority service, registered as a consequence of the communication between this car controller and the group controller which commands emergency priority service and indicates the floor). In order to indicate to the passengers which may be in the car at the time that the car call is forced, a step 16 forces a car call command from the car controller 15, 16 (FIG. 1) to the related cab controller 34, 35. A test 17 determines if the car door is fully closed or not. If it is not, the car is standing at a floor, and the door must be fully closed before the car can be moved to the floor requesting priority service. Thus a negative result of test 17 reaches a step 18 to generate a command that forces the door of the car to become closed. Then a series of steps 19–22 inhibit a plurality of functions: scanning of car call buttons by the car controller 15, 16 (FIG. 1); the car's status in the group controller 15 (that the car is no longer in the group), the group cannot impose motion demand on the car, nor can the group order the car to stop. The steps 20–22 ensure that the group cannot assign any hall calls to the car (or impose any other group functions on it, except those having a higher priority than emergency priority service, such as fireman service).

The present invention is contemplated as being usable in a system which reallocates all hall calls once in every major cycle of the group controller 17. Such a system is disclosed and claimed in a commonly owned U.S. patent application, DYNAMICALLY REEVALUATED ELEVATOR CALL ASSIGNMENTS, filed on Dec. 3, 1979 by Joseph Bittar, now U.S. Pat. No. 4,323,142. Thus, any hall calls previously registered in this car controller 15, 16 (FIG. 1) will become canceled within about one major cycle of the microprocessor within the car controller, so the car will no longer be answering any hall calls. The resetting of all car calls by the car controller subroutine 12 in FIG. 7, and the precluding of any reassignment of hall calls by the inhibits in steps 19–22 of FIG. 7 will ensure that the car has only the hall call established by steps 15 and 16 in FIG. 7 to which it shall respond in order to answer the emergency priority service call.

In FIG. 7, because of the car call which is forced in steps 15 and 16 in the usual case, eventually the car will achieve a committable position at the hall call floor, N (EPS), and that will cause the go command to be lost. Thus test 14 in FIG. 7 will be affirmative reaching a test 23 to determine if the doors of the car are fully open. Initially, they will not be, so that a negative result of test 23 will reach a step 24 to force the doors open. And the inhibits of step 19–22 will be passed through, since a given car might be assigned the EPS call when it has a committable position to the EPS floor and therefore the first pass through test 14 could be affirmative, requiring that the inhibits of step 19–22 be performed.

In FIG. 7, eventually the car will be standing at the EPS floor with the door fully open so that test 14 and test 23 are both affirmative. This will reach a test 25 which determines if the car has established an EPS reset to be sent to the group controller, or not. If not, a negative result of test 25 reaches a step 26 which causes the EPS car reset to be set to a ONE, and a step 27 which will start the EPS floor timer. This timer determines when a car has answered an emergency call, but the car is not utilized after an impermissibly long time, as is described more fully hereinafter. Because a given car could possibly be assigned an EPS call while it is standing at the EPS floor with its doors open, the route through affirmative results of tests 14 and 23 and the negative result of test 25 will also reach the inhibit steps 19–22.

On a subsequent pass through the routine of FIG. 7, the EPS car reset having been set in step 26, test 25 will be affirmative reaching a step 28 which inhibits door closing in the car. Thus the normal timing of a door operation, in which the doors are open, held open for a relatively short period of time (less than a minute) and then closed, will not be operative in emergency priority service. Instead, the car is put on independent service by an operator, by means of a suitable switch such as a keyed switch. A test 29 determines if the independent service switch has been activated or not. If not, a test 30 interrogates the emergency priority service floor timer to see if the car has been at the floor for an unduly long time (referred to as XS). If not, a negative result of test 30 reaches steps 24 and 19–22, simply as a convenient way to ensure that the doors remain forced open in step 24. If the independent service switch is not activated within a permissible time, an affirmative result of step 30 will terminate the EPS function of the car by reaching the reset steps 5–7. If the independent service switch is activated (as in the usual case), then a test 31 determines if a once-only independent service timer flag has been set. If not, a negative result of test 31 reaches a step 32 which sets the independent service timer flag and a step 33 which starts the independent service timer. This timer is designed to see if, once the car is put on independent service, it is given a command which causes the run status of the elevator within a permissible time. This is achieved by interrogating the run status of the elevator in a test 34; and if the elevator is not yet in a run condition, a negative result of test 34 will reach a test 35 which determines if the independent service time has been exceeded. During initial passes, the timer will not have timed out so that a negative result of step 35 will cause the program to advance through the end of routine point 8. On the other hand, if the run status is not achieved within a given amount of time, the EPS status of the car is terminated by means of the resets in steps 5–7. Similarly, once the run condition is established in the car, it is determined that the car is being operated on independent service (the emergency priority service call is in fact being utilized) so that an affirmative result of test 34 will similarly end the emergency priority service status of the car by the reset steps 5–7.

In the FIG. 7, once step 26 forces the EPS car reset to a ONE, the car controller will include that fact in a formatted word through the communication register units to the group controller, and the group controller will eventually sense the reset and act on it by placing a suitable bit in the map of EPS resets, and testing that map in test 12 of FIG. 2. That will cause step 13 to reset the emergency priority switch indicator at floor N and step 14 to remove the selected car from the map of cars assigned to EPS. Then in FIG. 4, since the car is no longer in the map of cars assigned to EPS, when the particular car involved is represented by the P pointer, step 4 will be negative and so the car directive to car P memory flag will be reset in step 5. When the car directive memory for car P is ZERO, the communications between the group controller and this particular car controller will no longer include refreshing the car EPS command. Therefore, the updating of the car EPS status following each communication of that portion of the formatted words from the group controller will result in the car EPS (tested in tests 3 and 9 of FIG. 7) to be absent so these tests will have negative results. Depending upon the condition and position of the car which is assigned to answer an emergency priority service call, it may take some time for the car to reach the call. In any case, however, when the car has reached the floor of the call and has its doors fully open, step 26 will cause the EPS car reset to equal ONE. Within one or two overall microprocessor cycles, this reset will be communicated to the group and back, so that test 9 in FIG. 7 will be negative. In the normal case, the first negative pass through test 9 after a car has reached an EPS call will generally precede the activation of the independent service switch. This is so because the operator must enter into the car and turn the switch (which could take several seconds) whereas the communication and operation of the group and car controllers can effect resetting of the car EPS within two or three machine cycles (less than a second). Thus a negative result of test 9 will reach test 10 and find that the car EPS status is not ZERO, so that a test **35*a* determines if the EPS status is ONE. In any first pass, the EPS status cannot be ONE since that can only be reset to ONE following a negative result of test 35*a* and a negative result of a test 36 which determines if this car has caused its EPS car reset to be equal to ONE. And in the general case, test 36 will be affirmative; the only time that test 36 will be negative is if the group had forced resetting of the car EPS for reasons other than that the car was answering the call (as described briefly hereinbefore). Should that happen, a negative result of test 36 will cause a step 37 to set the EPS status to ONE and a subroutine 12 will cause resetting of all car calls, then a step 38 determines if the door is fully open, and if it is a step 39 causes the EPS status to be set to ZERO, and in either case a step 40** sets the car operation control status to force the car to stop and the doors to open. Therefore, whenever the group commands the removal of the EPS status of the car for reasons other than the car indicating that it can be reset, the EPS status of ONE is utilized to reset car calls, force the car to stop and the doors to open, and after the doors are open to again set the status to ZERO indicating that the car has no more emergency priority service performance.

In a normal case when test 9 is negative because the car EPS has been reset as requested, but the car has not yet been put on independent service and run, test 10 is negative, test **35*a* is negative, test 36 is affirmative so that steps and tests 28–35 are reached in the same fashion as they are from an affirmative result of test 25. These latter tests and steps simply determine that the car has achieved independent service and run, or that independent service or the run status were not achieved within permissible times, and removes the car from EPS status by resetting the car EPS status to ZERO (step 6), resetting the EPS car reset request to ZERO (step 5) and resetting the independent service timer flag (step 7**).

One aspect of the invention illustrated in step 5 of FIG. 2 is first considering the committable floors of the car with respect to emergency priority service calls. This is utilized in steps 17 and 18 of FIG. 2 and the assignment routine of FIG. 6 to directly assign any EPS call to a cars committed position if it can be done. It is also used to reset those EPS requests which have been responded to. Another aspect of the invention is the shortening of the polling of the floors of the building in search of EPS requests to be assigned whenever no cars are available by step 14 of FIG. 3 so as to give other floors a better chance of being able to have an EPS call assigned thereafter, rather than always starting at the highest or lowest floor in the polling sequence. A related aspect is the resetting of the call where it is determined that there are not cars available (steps 12 and 13 of FIG. 3), so as to provide an indication to the requestor that such a call cannot be answered at this time. A related feature is illustrated in test 10 of FIG. 3 which permits reassigning a call if an assigned car has not responded thereto within a reasonable time. Another aspect is selecting a car for response to an EPS call which can get to the floor of the call most quickly, as is illustrated in the middle of FIG. 5, including the distance of the car to the call, and penalties for not having the car door closed or for running in a direction away from the call. Another feature of the invention is canceling a car's EPS status and its reset signal that it provides to the group (steps 5 and 6, FIG. 7) if the car is not put on independent service within a permissible time from reaching the EPS floor with its doors open. A related feature is canceling such signals if after being placed on independent service, it is not run within a permissible time. This is illustrated by tests 30 and 35 in FIG. 7.

The foregoing description is of an exemplary embodiment of the various aspects of the invention as may be implemented in a microprocessor based group controller and microprocessor based car controllers. The individual steps and tests indicated may be varied to some degree to suit any particular microprocessor which may be used, or to provide substantially the same result in different ways, or different order. Further, the invention may be implemented utilizing dedicated digital or analog hardware or circuitry, in a manner which is directly analogous to the microprocessor implementations described hereinbefore. Also, it should be obvious that some of the aspects of the invention may readily be used without using other aspects of the invention.

Thus although the various aspects of the present invention have been shown and described with respect to exemplary embodiments thereof, it should be understood by those skilled in the art that the foregoing and various other changes, omissions and additions may be made therein and thereto, without departing from the spirit and the scope of the invention.

We claim:

1. An elevator system having a plurality of elevators movable in respective shaftways between a plurality of floor landings in a building for servicing said landings, comprising:

a plurality of request means, each corresponding to one of said landings, each selectively actuable for providing an EPS request signal indicative of a request for express priority service to said corresponding one of said landings;

a group controller, interconnected for signal communication with each of said elevators and each of said request means, for registering all of said EPS request signals, and cyclicly operable in a repetitive sequence for providing available cars signals indicative of elevators which may be assigned to respond to EPS requests, for providing a plurality of landing signals in a repetitive, successive sequence from a first landing through a last landing, for assigning a selected one of said elevators which is indicated by said available cars signals as being available, to respond to one of said EPS calls by providing EPS assignment signals, indicative of the one of said elevators so assigned and the landing of the EPS request, in response to said available cars signals, said EPS signals and said landing signals, and for communicating said EPS assignment signal to the elevator indicated thereby;

each of said elevators including means responsive to said EPS assignment signals provided thereto by said group controller to proceed to the landing designated thereby to service said landing;

characterized by:

said group controller means comprising means for providing, in each cycle, a next landing signal indicative of the landing in said sequence in response to which said EPS assignment signal is to be provided first in said subsequent cycle, for iteratively, in each cycle, testing the EPS signal for one or more landings beginning with the landing designated by said next landing signal and proceeding with successive landings in said sequence, either to said last landing in cycles of a first condition in which there is no EPS signal, for any landing from the one designated by said next landing signal to said last landing, for which there is no concurrent available car signal, or, in cycles of a second condition to a landing for which there is a corresponding EPS request signal concurrently with no available car signal, for providing said assignment signals for any EPS request signal tested in cycles of said first condition, for providing said next landing signal to designate said first landing after testing for said last landing in cycles of said first condition, and for providing said next landing signal to designate the next landing in said sequence subsequent to the one for which an EPS request cannot be assigned for lack of an available car, after testing for such landing in cycles of said second condition.

2. An elevator system according to claim 1 characterized by said group controller means comprising means for providing a signal to indicate at the corresponding landing the receipt of an EPS signal for such landing, and means to eliminate said signal in cycles of said second condition in which testing for such landing is concurrent with no available car signal.

3. An elevator system according to claim 1 characterized by said group controller means comprising means for providing, for each landing tested, a first signal indicative of there being an EPS request signal concurrently with no car assigned to such landing to respond thereto, for providing a second signal indicative of there being an EPS request signal for such landing and a car has previously been assigned thereto for an impermissibly long time, and for providing said assignment signal in response to said first signal or said second signal on concurrence of said EPS request signal and said available car signal.

4. An elevator system having a plurality of elevators movable in respective shaftways between a plurality of floor landings in a building for servicing said landings, comprising:

a plurality of request means, each corresponding to one of said landings, each selectively actuable for providing an EPS request signal indicative of a request for express priority service to said corresponding one of said landings;

a group controller, interconnected for signal communication with each of said elevators and each of said request means, for registering all of said EPS request signals, and cyclicly operable in a repetitive sequence for providing available cars signals indicative of elevators which may be assigned to respond to EPS requests, for assigning a selected one of said elevators which is indicated by said available cars signals as being available, to respond to one of said EPS calls by providing EPS assignment signals, indicative of the one of said elevators so assigned and the landing of the EPS request, in response to said available cars signals and said EPS signals, and for communicating said EPS assignment signal to the elevator indicated thereby;

each of said elevators including means responsive to said EPS assignment signals provided thereto by said group controller to proceed to the landing designated thereby to service said landing;

characterized by:

each of said elevators comprising means for providing a committable landing signal to said group controller indicative of the landing at which it is or currently could be stopped and for providing to said group controller means an EPS car reset signal when it has reached the landing of an EPS request assigned thereto and opened its doors; and said group controller means comprising means responsive to said committable landing signals of each of said elevators for providing said assignment signals to designate a car for response to an EPS request signal in response to the committable floor signal of such car indicating the same landing as said EPS request signal and for eliminating one of said EPS request signals in response to concurrence of an EPS request signal, for a landing indicated by the committable landing signal of a car which is designated by an assignment signal as assigned to such call, with such committable floor signal and such assignment signal.

5. An elevator system having a plurality of elevators movable in respective shaftways between a plurality of floor landings in a building for servicing said landings, comprising:

a plurality of request means, each corresponding to one of said landings, each selectively actuable for providing an EPS request signal indicative of a request for express priority service to said corresponding one of said landings;

a group controller, interconnected for signal communication with each of said elevators and each of said request means, for registering all of said EPS request signals, and cyclicly operable in a repetitive sequence for providing available cars signals indicative of elevators which may be assigned to respond to EPS requests, for assigning a selected one of said elevators which is indicated by said available cars signals as being available, to respond to one of said EPS calls by providing EPS assignment signals, indicative of the one of said elevators so assigned and the landing of the EPS request, in response to said available cars signals and said EPS signals, and for communicating said EPS assignment signal to the elevator indicated thereby;

each of said elevators including means responsive to said EPS assignment signals provided thereto by said group controller to proceed to the landing designated thereby to service said landing;

characterized by:

each of said elevators providing to said group controller a committable landing signal indicative of a landing at which it is or currently could be stopped, advance signals indicative of its direction of advancement in the related shaftway, a run signal indicating that the elevator is being commanded to run, and a door signal indicative of the doors of the elevator being fully closed; and said group controller means comprising means iteratively responsive in each cycle to signals provided by each of said elevators for which there is a corresponding one of said available car signals, to provide a distance signal indicative of the number of landings between the landing indicated by the related committable landing signal and the landing indicated by the EPS request signal being assigned, for providing a first penalty signal in response to the absence of the related one of said door signals, for providing a second penalty signal in response to the related ones of said committable floor signal and said advance signal indicating that the related elevator is advancing away from the landing of the EPS request to be assigned, and for providing said assignment signals to designate the one of such elevators corresponding to which the summation of the number of floors and penalties indicated by the related floor signal, first penalty signal and second penalty signal is the lowest.

6. An elevator system according to claim 5 characterized by said first penalty signal and said second penalty signal each being indicative of a small number of floors.

7. An elevator system having a plurality of elevators movable in respective shaftways between a plurality of floor landings in a building for servicing said landings, comprising:

a plurality of request means, each corresponding to one of said landings, each selectively actuable for providing an EPS request signal indicative of a request for express priority service to said corresponding one of said landings;

a group controller, interconnected for signal communication with each of said elevators and each of said request means, for registering all of said EPS request signals, and cyclicly operable in a repetitive sequence for providing available cars signals indicative of elevators which may be assigned to respond to EPS requests, for assigning a selected one of said elevators which is indicated by said available cars signals as being available, to respond to one of said EPS calls by providing EPS assignment signals, indicative of the one of said elevators so assigned and the landing of the EPS request, in response to said available cars signals and said EPS signals, and for communicating said EPS assignment signal to the elevator indicated thereby;

each of said elevators including means responsive to said EPS assignment signals provided thereto by said group controller to proceed to the landing designated thereby to service said landing;

characterized by:

each of said elevators comprising means for providing an EPS status signal indicative of its assignment to respond to an EPS request in response to a related one of said assignment signals, for providing to said group controller means a reset EPS signal in response to reaching the landing of an assigned EPS request and opening its doors, for providing a signal indicative of the elevator being placed on independent service by a passenger thereof, for providing a run signal indicative of the elevator being commanded to move in response to a demand for service, for providing an excess floor time signal in the event that said independent service signal is not present within a first time interval of said reset EPS signal being provided, and for eliminating said EPS status signal and said reset EPS signal in response to either said run signal or said excess floor time sigal.

8. An elevator system according to claim 7 characterized by each of said elevators comprising means for providing an excess service time signal in the event that said run signal is not present within a second time interval of said independent service signal being provided, and for eliminating said EPS status signal and said reset EPS signal in response to said excess service time signal.

* * * * *